US008099848B2

(12) United States Patent
Lescarcelle

(10) Patent No.: US 8,099,848 B2
(45) Date of Patent: Jan. 24, 2012

(54) METHOD AND DEVICE FOR REMOVING THIMBLES FROM ANODE LEGS

(75) Inventor: Didier Lescarcelle, Lambres les Douai (FR)

(73) Assignee: E.C.L, Ronchin (FR)

( * ) Notice: Subject to any disclaimer, the term of this patent is extended or adjusted under 35 U.S.C. 154(b) by 68 days.

(21) Appl. No.: 12/743,087

(22) PCT Filed: Nov. 7, 2008

(86) PCT No.: PCT/FR2008/001574

§ 371 (c)(1),
(2), (4) Date: May 14, 2010

(87) PCT Pub. No.: WO2009/098367

PCT Pub. Date: Aug. 13, 2009

(65) Prior Publication Data

US 2010/0229700 A1 Sep. 16, 2010

(30) Foreign Application Priority Data

Nov. 14, 2007 (FR) ..... 07 07989

(51) Int. Cl.
*B23P 6/00* (2006.01)
*C25C 3/00* (2006.01)

(52) U.S. Cl. ..... 29/402.01; 29/402.03; 29/402.06; 204/245; 204/247.2; 205/389

(58) Field of Classification Search ..... 29/402.01, 29/402.03, 402.06; 204/245, 247.2; 205/389
See application file for complete search history.

(56) References Cited

U.S. PATENT DOCUMENTS 5,733,423 A * 3/1998 Caspelherr ..... 204/279
5,956,842 A * 9/1999 Stewart ..... 29/825
6,773,574 B2 * 8/2004 Kubsik ..... 205/389
2008/0307625 A1 * 12/2008 Lescarcelle ..... 29/402.08

FOREIGN PATENT DOCUMENTS

| | | | |
|---|---|---|---|
| DE | 4410599 | A | 9/1995 |
| FR | 2718989 | A | 10/1995 |
| FR | 2894988 | A | 6/2007 |
| WO | 0157291 | A | 8/2001 |

OTHER PUBLICATIONS

International Search Report dated Jun. 26, 2009 (PCT/FR2008/001574); ISA/EP.
Preliminary Search Report dated Jun. 13, 2008 (FR0707989); SA/FR.

* cited by examiner

*Primary Examiner* — Carl Arbes
(74) *Attorney, Agent, or Firm* — Banner & Witcoff, Ltd.

(57) ABSTRACT

A process for removing in a single step the thimbles attached to the stubs of an anode leg, including the following steps:

Figure 1:
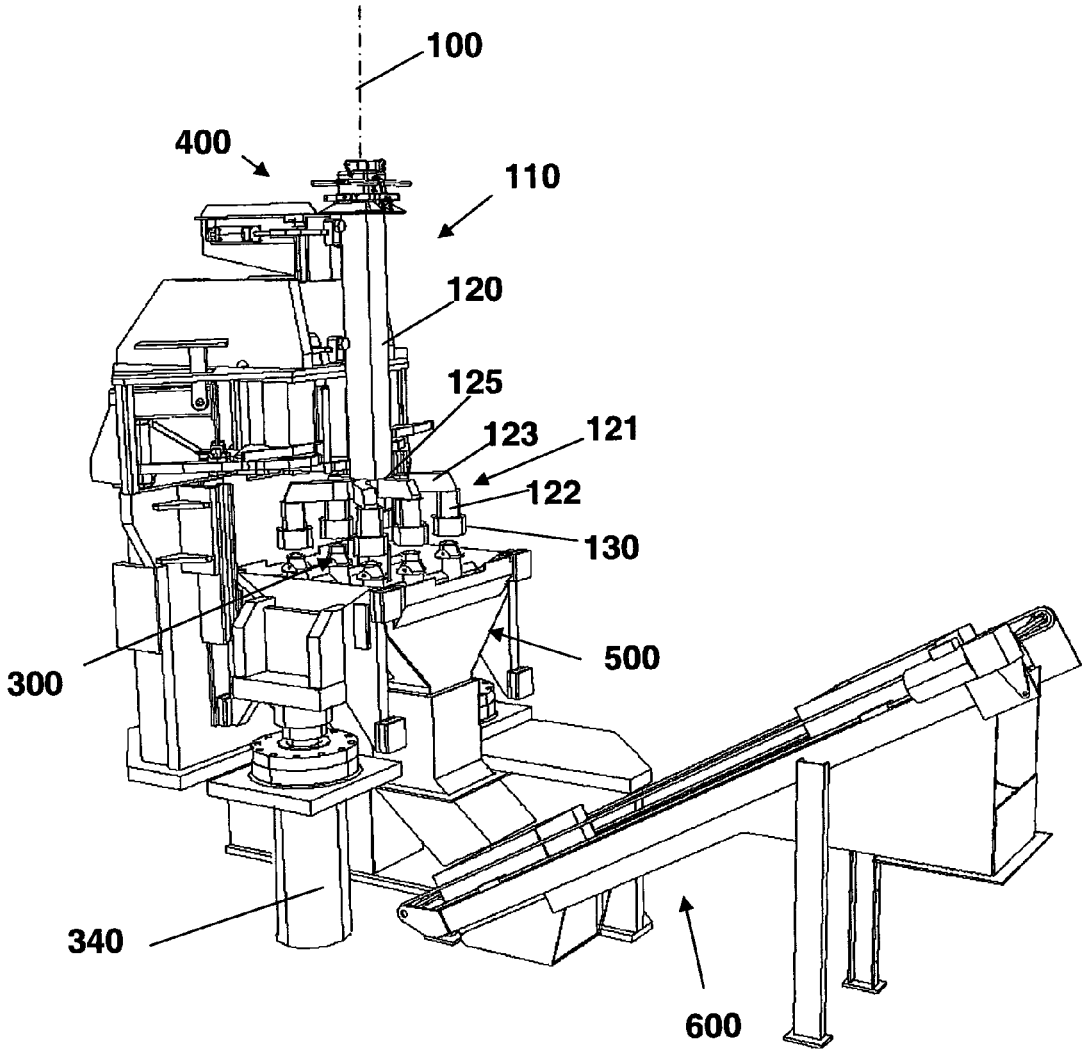

a) said anode stem leg is placed between a stop device and an attacking device, said stop device surrounding, at least partially, each stub of said anode stem leg and having a stop surface that stops the corresponding thimble from moving forward;

b) movement of the attacking device in the direction of the stop device until said anode leg enters into contact with said stop device;

c) continuation of the movement of said attack device so that each thimble, blocked by the associated stop surface, is detached from the corresponding stub;

f) stop and withdraw of the attacking device;

In this process, a stop device is used comprising at least two stop surfaces, separated from one another by an axial distance such that the thimbles blocked by a first stop surface are detached from the stubs before the other thimbles are blocked by the other stop surface.

22 Claims, 3 Drawing Sheets

METHOD AND DEVICE FOR REMOVING THIMBLES FROM ANODE LEGS

The present application is a National Phase filing of International Application No. PCT/FR2008/001574, filed Nov. 7, 2008, which claims priority to France Patent Application No. 0707989, filed Nov. 14, 2007, both of which the present application claims priority to and the benefit of, and both of which are incorporated by reference herein in their entireties.

TECHNICAL FIELD

The invention relates to the production of aluminium by igneous electrolysis. It particularly concerns a process for removing the metal bushings attached to the legs of the anode stems so as to reuse said stems after cleaning and to recycle the material of the removed bushings.

BACKGROUND OF RELATED ART

The anodes include a conducting metal stem, in conjunction with a device for fixing to said superstructure and with an electrical connection device, and a block made of carbonaceous material which constitutes the body of the anode and which is introduced into the electrolyte bath. The connection between the anode stem and the body made of carbonaceous material is made via a leg, typically made of steel, integral with the base of the stem and which in general has the shape of an upside-down candelabrum, each branch of the candelabrum being associated with a cylindrical end whose axis is parallel to the stem and known as a "stub". Generally speaking, these stubs are inserted inside cavities made on the top face of the block of carbonaceous material and the gaps between the stubs and the bores are filled with molten metal, typically cast iron. The metal bushings thus formed—also referred to as "thimbles"—make it possible to ensure good mechanical attachment and good electrical connection between the stem and the block of carbonaceous material.

In operation, an electrolysis plant requires regular replacement of the anodes which are consumed throughout the aluminium production process. Regeneration of a spent anode is an economically necessary operation which involves removing the cooled electrolyte bath attached to the anode butt (residual carbon block), then removing the butt and the thimbles to recycle them, and finally cleaning and if necessary rectifying the assembly made up of the stem and the anode leg in order to associate it with a new block of carbonaceous material and thereby to obtain a new anode. In addition, certain new anodes (typically 1 to 2% of them) may be defective, for example a cracked block of carbon, and must be set aside so that they can be returned and recycled directly with the spent anodes, without ever having been inserted into the electrolysis cells.

Until now, the leftover fragments of anode and the thimbles were removed using stripping machines, the anode being held in vertical position. The anode legs were more or less directly subjected to the forces exerted by the stripping machine and their lifespan was very short.

Generally speaking, the stripping machines are specialised: those used to remove residual blocks are called "anode butt strippers" and those used to remove the thimbles are called "thimble strippers". Certain devices, called "butt and thimble removal presses" allow anode butt breaking and thimble stripping to be carried out in a single movement.

In practise, owing to the forces generated, the thimble strippers remove one single thimble at a time. For example, German patent application DE 44 10 599 describes a device enabling anode butt and thimble stripping around each stub of an anode leg: a clamp closes to partially rotate said stub, without touching it, its lower face used as an axial stop that prevents the movement of the thimble which is driven, via the stub, by a punch. The stop device and the punch are mobile in relation to the stub and can move towards one other by means of an actuator. By means of a cavity worked into the stop device and which surrounds the stub, with a diameter greater than that of the thimble, the punch initially breaks up the butt, removes the butt fragments and then deforms and detaches the thimbles. Such a thimble stripping device, associated with or without an anode butt stripping device, has the advantage of soliciting the anode stem only locally, the stripping forces being directly supported by the upper part of the grip which acts as a counter brace. However, this particularly bulky device can work on one single stub only, which presents the drawback of requiring a significant amount of time to completely strip an anode stem.

Several documents in the prior art describe less bulky machines working simultaneously on several stubs.

French patent application FR 2 718 989, and U.S. Pat. No. 5,733,423, propose a thimble stripping machine equipped with a plurality of twisting devices acting simultaneously on each thimble. In this solution, the replacement of punches moving axially with devices driven in rotation requires separating anode butt stripping from thimble stripping operation, that is to specifically use a specialised machine for stripping the anode butts then a specialised machine for stripping the thimbles. Furthermore, the risk of damaging the anode legs does not disappear, even if the type is changed: the twisting torque is transmitted to a brittle zone of the stub, where the latter is welded to the transverse branch.

U.S. Pat. No. 5,956,842 describes a combination anode butt and thimble removal apparatus with vertically moving punches associated with axial stops. These are slender punches, placed below the stubs and in line with them, of smaller diameter than that of the stubs and acting upwards. When the punches move up, the later first make contact with the butt then, after the butt is stripped, make contact with the lower face of the stubs, such that the top face of the thimbles are blocked by a stop, the thimbles deform and are detached from the stubs, while remaining trapped by the slender punches. The stop is made up of the lower face of the clamps which close individually around each stub without touching them. The drawback associated with this solution resides in the amount of force that must be provided to simultaneously strip the thimbles from all the stubs. Furthermore, the clamps themselves bear on a common plate, the support of the stripping forces is not really customized such that the anode leg remains sensitive to the unbalanced stresses resulting from the imperfectly symmetrical stresses of the anode leg.

Furthermore, the butt and thimble removal apparatus proposed by the applicant in French patent application FR 2 894 988, presents jaws that close individually around each stub so that a stop prevents the thimbles from rising, driven by the punches via the stubs. The individual support of the stripping forces allows the anode legs to be treated but significant force must also be provided here to simultaneously strip the thimbles from all the stubs.

International application WO01/57291 addresses the well-known problem of the imperfect geometry of anode stems frequently used and recycled in an electrolysis workshop: their transverse arms are more or less inclined and the stubs are more or less worn, such that the ends of the stubs and the associated thimbles are not all on the same level in relation to the forward movement of the punches. According to the author of WO01/57921, the imbalance of forces due to the imperfect routine geometries of the anode legs is such that the movement of the punches and their contact with the end of the stubs must be checked individually: in this way, the moment when each punch enters into contact with the stub with which is associated is controlled and the stripping of the stubs is triggered in a synchronised manner. This device thus requires the implementation of a large set of individual punch actuators and a complex electronic control system for these actuators. Furthermore, a significant amount of force must always be supplied in order to simultaneously strip the thimbles from all the stubs.

The object of the invention is to define a process for stripping thimbles from used (or scrapped new) anodes that does not present the drawbacks presented above, particularly which enables thimbles to be stripped from all stubs of an anode leg in one step and with a single machine, without the use of considerable force, without requiring the introduction of a complex electronic control system, while attempting to keep the risk of damage to the anode leg as low as possible.

Advantageously, the machine used to implement this process could also be used to remove the anode butts. In addition, in this last case, the anode block fragments and thimbles could advantageously be sorted upon exiting this same machine, as in FR 2 894 988, and then sent directly to the anode manufacturing workshops for recycling.

DESCRIPTION OF THE INVENTION

A first subject according to the invention is a process allowing the n thimbles attached to n stubs of an anode stem leg to be removed in a single step, n being a whole number greater than or equal to 3, said process comprising at least the following steps:

a) said anode stem leg is placed between a stop device and an attacking device, said attacking device can be moved, using an actuator, towards said stop device, said stop device at least partially surrounding each of the n stubs of said anode stem leg and having a stop surface that stops the corresponding thimble from moving forward;

b) movement of the attacking device in the direction of the stop device so that said attacking device enters into contact with the anode leg and drives it until said anode leg comes into contact with said stop device;

c) continuation of the movement of said attacking device so that each thimble, blocked by the associated stop surface, is detached from the corresponding stub;

f) stop and withdraw of the attacking device;

said process being characterised in that a stop device is used comprising at least two stop surfaces, separated from one another by an axial distance such that the thimbles blocked by a first stop surface are detached from the stubs to which they were secured before other thimbles are blocked by the other stop surface.

The attacking device can be moved using at least one actuator, typically a hydraulic actuating cylinder. Movement may be a simple translation or, as in DE 44 10 599, a rotation around a horizontal axis. In fact, movement can be along a substantially constant unspecified direction, globally defined by the pair formed by the relative position of the attacking device in relation to the stop device, the attack needing to be carried out substantially from the front. In the following, movements in this direction will be termed "axial" movements. In practise, the vertical direction is chosen, which makes it possible to avoid having to set up an additional anode handling device. The spent anode is generally transported using an overhead conveyor, vertically, i.e. fixed to the conveyor by the top end of its stem. Once placed in the machine, its stem is held by securing means, typically centring clamps, which allow axial movement of the stem, the stem leg needing to be able to move in this direction when it is reached by the attacking device. In order to allow said axial movement, the securing means are advantageously provided, on contact with the stem, with pads having a low friction coefficient.

According to the invention, the attacking device comprises a plurality of n punches which move along the axes of n stubs. In a preferred embodiment of the invention, they move forward simultaneously, typically mounted on a transverse beam or several linked transverse beams, moved by one or more actuators, such as hydraulic cylinders, for example.

The stop device surrounds, at least partially, each of the n stubs of said anode stem leg: typically, this stop device takes the form of a part or a set of several parts bearing, directly or indirectly, on one or more elements secured to the frame of the machine and having, at each stub, a recess surrounding the stub which allows the latter to move axially by passing through it and a stop face that prevents the thimble associated with the corresponding stub from moving forward axially. Typically, the recess takes the form of a bore or a portion of bore which surrounds at least partially the stub, for example with a diameter greater by at least 1 mm than the external diameter of the thimbles. Particularly, when the stubs are slightly tapered, a lateral cavity, corresponding to the passage of the transverse arm of the stem leg supporting said stub, can be connected to this bore to complete said recess. Said bore is surmounted, in its upper part, by a shoulder or an internal projecting edge, of radial height typically equal to the thickness of the thimble, and whose lower face acts as a stop surface that prevents the thimble from moving forward.

According to the invention, the stop device comprises at least two stop surfaces located on a different level in relation to the forward movement of the attacking device, so that certain thimbles are stopped as the punch moves forward and thus removed from their stubs while other thimbles, not blocked, remain fixed on their respective stubs. This allows the stripping force to be decreased. In order to prevent an imbalance of the stresses detrimental to the correct resistance of the stem leg, it is advantageous to associate the stop surfaces of the same level to the stub thimbles arranged in a symmetrical manner in relation to the axis of the stem. Before developing this point, it is useful to describe the routine configurations taken by the stubs of the anode stem legs.

As attempts are made to obtain the most homogenous current density possible inside the anode block, the stubs are arranged either in line, for the narrower anodes, in the direction of the large side of the anode block, or in a symmetrical manner in relation to the middle plane of the anode block, parallel to the large side. If the stubs are in line, n can be odd and if n is odd ($n=2p+1$), the anode leg features an axial stub located in the stem axis. But in all other cases, the stubs are in even numbers and arranged symmetrically in relation to the stem axis. The leg thus comprises p pairs of so-called "peripheral" associated stubs, in the sense that none of them pass through the stem axis even if some of them are near it. Thus, whether n is pair ($n=2p$) or odd ($n=2p+1$), the anode leg generally comprises p pairs of associated peripheral stubs, which are symmetrical in relation to the stem axis, and possibly an axial stub.

So preferably, the stop device comprises at least a first stop surface intended to stop the forward movement of the thimbles fixed on two associated peripheral stubs, symmetrical in relation to the stem axis and a second stop surface, shifted axially in relation to the first stop surface, intended to block either a first pair of thimbles fixed on other associated peripheral stubs or, if it exists, the thimble fixed on the axial stub.

Advantageously, a specific stop level corresponds to each pair of associated peripheral stubs. This stop level is shifted axially from that of the other pairs of peripheral stubs and that of the axial stub, if it exists.

The removal of the thimbles and the stubs results from the immobilisation of the thimble while the punch continues to progress forward. An axial force is generated in the thimble in reaction to the force transmitted by the attacking device via the punch and the stub. Cleavage stress is created in the thickness of the thimble, probably with a maximum intensity within the vicinity of this contact surface, which increases as the punch moves forward until it reaches a critical value, at which point the thimble deforms and detaches from the external surface of the stub. p The axial shift is such that, as the attacking device moves, the "first" thimbles blocked by a first stop surface become detached from the stubs to which they were fixed before the other thimbles are blocked by a second stop surface. It is, however, possible that the "first" thimbles are not yet shattered and ejected from the anode stem before the other thimbles are blocked by a second stop surface.

The amount of shift depends on the geometries involved, particularly that of the stem leg, stubs and the contact surface between the thimbles and the stubs. For hexapods having stubs of 180 mm in diameter, transverse arms typically measuring roughly 500 mm in length (distance between associated stubs in the order of 1,000 mm) and cross-sectional area typically in the vicinity of 1,170 $mm^2$, and with thimbles attached to the stubs over a height of 130 mm, the axial shift between two stop surfaces must be at least equal to a value in the order of 20 mm. In order to account for the various geometries possible, the axial shift is advantageously between 5 and 50 mm, preferably between 10 and 30 mm.

In order to reduce the risks of anode leg damage associated with the imbalance of stresses resulting from the imperfect geometry of said anode leg, particularly resulting from the height of the associated stubs not rigorously equal, it is advantageous to use a set of individual stop units as a stop device, each individual stop unit being associated with a single stub. Preferably, each individual stop unit comprises a fixed stop integral with the machine frame, said stop opposing the axial forward movement of the thimble associated with the corresponding stub, and a device mounted in a floating manner in relation to the machine frame, said device mounted in a floating manner being placed on the thimble when it arrives in contact with it such that the contact surface with the upper end of the thimble is as large as possible, said placement being performed, that is achieved or substantially advanced, before, driven by the thimble, said device mounted in a floating manner itself arrives against said stop integral with the machine frame. Such a device mounted in a floating manner comprises an intermediate part enabling the stop device to better mechanically withstand the jerks due to variations in geometry, particularly of the thimbles.

Several stop unit variants were considered, particularly sets clamp assemblies and sleeve assemblies.

The stop units can include clamps whose lower face comprises, once the clamp is closed around a stub, a stop surface preventing the corresponding thimble from moving; several embodiments are possible:

a) One of the clamps' faces bears on one or several elements integral with the frame, located on the same level in relation to the forward movement of the attacking device, and they are of different thickness so that they present their other face as a stop surface with a different level.

b) The clamps have the same thickness although bear on different levels on elements integral with the frame;

c) In order to prevent that certain parts are too thick, the two previous solutions are combined: the clamps bear on one or several elements integral with the frame, located at levels in relation to the forward movement of the attacking device, and they have different thicknesses, the differences in level of the elements integral with the frame and the thicknesses of the clamps were defined so that the clamps present their other face as a stop surface with a different level.

As indicated previously, these clamps are advantageously mounted in a floating manner in relation to the machine frame.

As in FR 2 894 988, the stop units can include jaw assemblies, typically pairs of jaws, which pivot around horizontal axes and which, once brought together, form a sort of sleeve that surrounds the stub and whose lower end is equipped with a stop surface preventing the thimbles from moving. The possible embodiments are identical to modes a), b) and c) described previously for the clamps, the thickness of the clamps being replaced here by the height of the sleeves.

The attacking device comprises n punches which move along the axes of the n stubs. Advantageously, they are mounted on a common transverse beam (in the case of aligned stubs) or on several transverse beams arranged symmetrically (in the case of stubs arranged symmetrically) in relation to the median plane parallel to the large side of the anode block. This beam or these beams, integral with one another, is(are) moved by one or more actuators, such as hydraulic cylinders, for example. In this way, the punches reach the lower ends of the stubs nearly simultaneously. The thimbles are attacked in twos, symmetrically in relation to the axis of the anode stem. If a thimble "releases" slightly before the other symmetrical thimble associated with it, a sudden and significant imbalance may follow on the attacking device. In order to prevent this, the latter is advantageously equipped with guide shoes that slide on the vertical walls integral to the machine frame, provided to act as counter-bracing and guide walls to the vertical movement of said attacking device.

Another object of the invention is a thimble stripping machine enabling the process described to be implemented, able to remove both spent anodes and scrapped new anodes from the stubs, comprising a stop device and an attacking device, said attacking device that can be moved by means of an actuator in the direction of said stop device, said stop device surrounding, at least partially, each stub of the anode stem leg and comprising at least two stop surfaces separated from one another by an axial distance such that the thimbles blocked by a first stop surface are detached from the stubs to which they were secured before the other thimbles are blocked by the other stop surface.

This machine can have the additional characteristics or variants described above to illustrate the process.

Advantageously, the forward movement of the attacking device can also be used to remove the anode butt before stripping the thimble. Another subject according to the invention is thus a process making it possible to extract the anode butt and thimbles attached to a spent anode, including the following stages:

a) placement of the spent anode butt between a stop device and an attacking device, said attacking device being movable using an actuator in the direction of said stop device, said stop device comprising a butt stop device having a first stop, called a "butt stop" blocking the forward movement of the butt, said butt device also comprising a stop device of the thimbles surrounding, at least partially, each stub and having a second stop, called a "thimble stop", which stops said thimbles from moving forward;

b) the spent anode is moved until the butt is blocked by the first stop;

c) the attacking device is moved towards the stop device so that it arrives in contact with said anode butt and imposes such a force on said butt causing it to break up and the fragments to be detached from the butt;

d) the fragments of butt are removed;

e) the attacking device continues to move so that the thimbles are blocked by the second stop and are detached from the stubs;

f) the attacking device stops and is withdrawn;

said process being characterised in that a stop device is used comprising at least two separate stop surfaces, separated from one another by an axial distance such that the thimbles blocked by a first stop surface are detached from the stubs to which they were secured before other thimbles are blocked by the other stop surface.

Advantageously, in order to be able to separate waste of various types straight away (carbonaceous fragments and cast iron wastes), an axial distance between said first stop, or "butt stop" and said second stop, or "thimble stop" is imposed, as in FR 2 894 988, which must be greater than or substantially equal to the height of said thimbles. As the stop surfaces of the thimbles are not all on the same level, it is the axial distance between the thimble stop surface closest to the butt stop surface and the butt stop surface, in other words the minimal axial distance between the thimble stop surfaces and the butt stop surface, that must be greater than a value, substantially corresponding to the height of the thimbles, that is typically greater than half the height of said thimbles and preferably at least equal to said height.

Another object of the invention is an anode butt and thimble removal machine enabling the process described above to be implemented to extract the anode butt and the thimbles attached to a spent anode or a scrapped new anode, comprising a stop device and an attacking device, said attacking device being movable using an actuator in the direction of said stop device, said stop device comprising a butt stop device having a first stop, called "butt stop" preventing the butt from moving forward, said stop device also comprising a stop device of the thimbles surrounding, at least partially, each stub and having a second stop, called a "thimble stop", that stops said thimbles from moving forward, characterised in that the thimble stop device comprises at least two stop surfaces separated from one another by an axial distance such that the thimbles blocked by a first stop surface are detached from the stubs to which they are secured before other thimbles are blocked by the other stop surface.

This machine can have the additional characteristics or variants described above to illustrate the process.

FIGURES

FIG. 1 schematically represents a perspective view of an anode removal and thimble stripping machine implementing the thimble stripping process according to the invention, associated with or without anode butt removal. As illustrated, part of the machine's elements have been removed to show the anode stem to be stripped and the attacking device.

Figure 2:
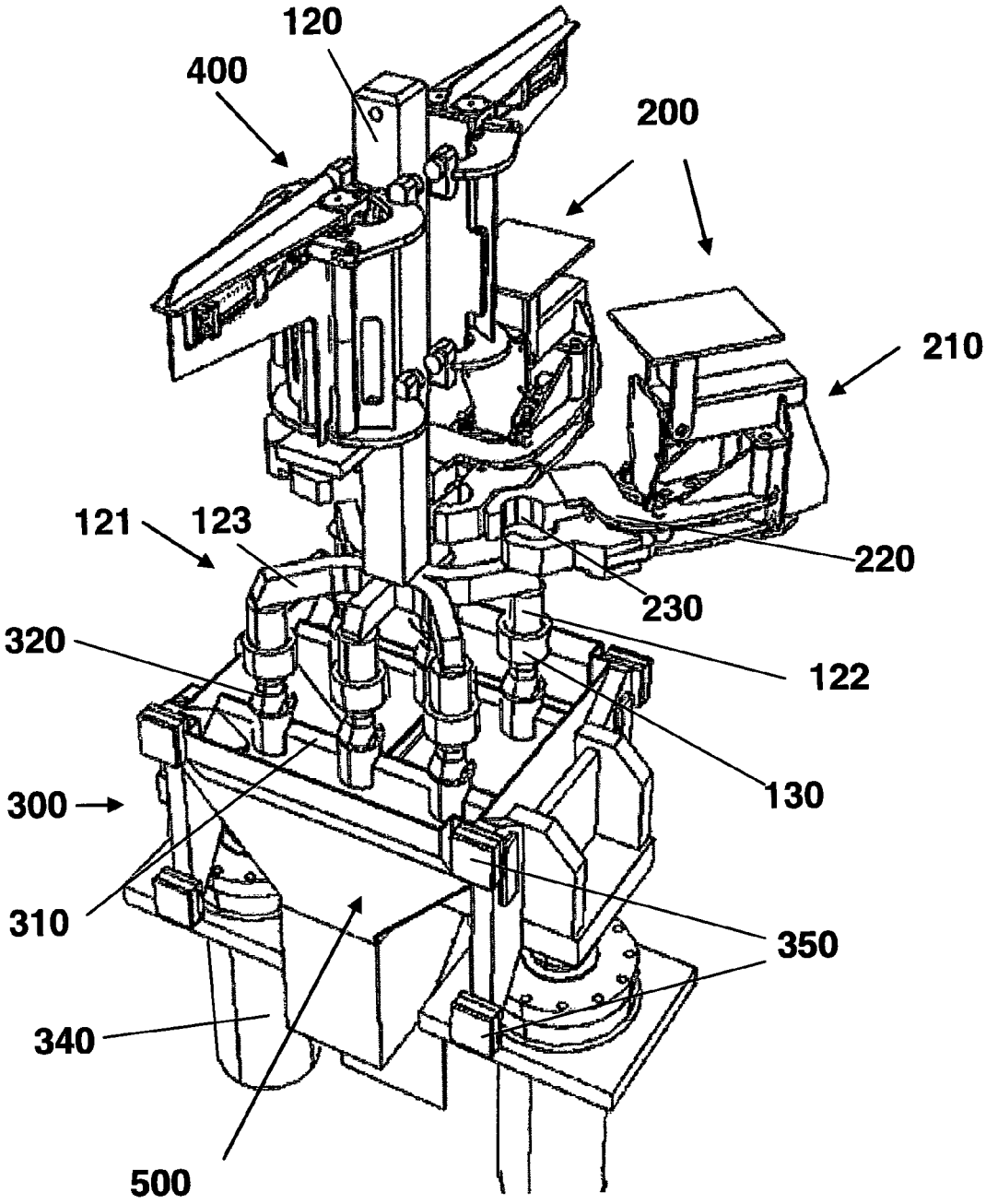

FIG. 2 completes the illustration of FIG. 1 and schematically details, in an overhead perspective view, certain elements of the machine, notably including the stop device.

Figure 3:
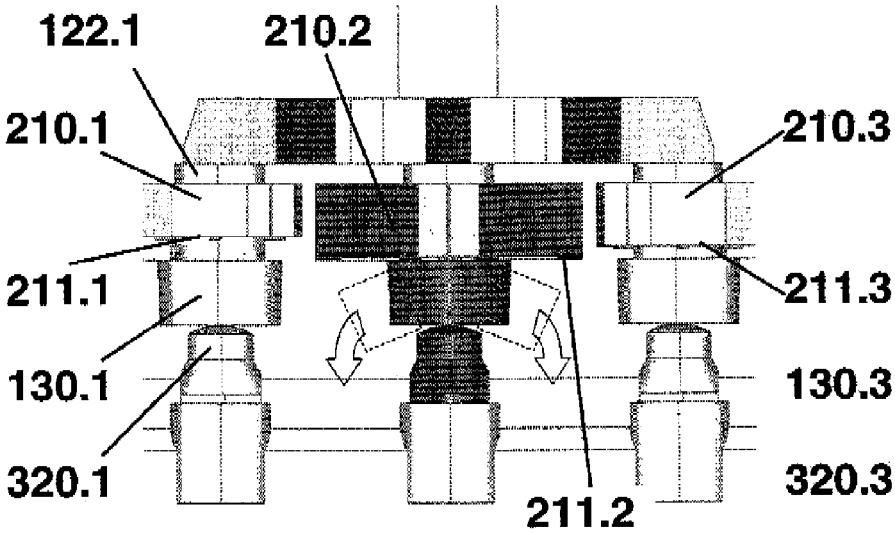

FIG. 3 completes the illustrations of the previous figures by showing a front view of half the stubs still equipped with thimbles, the part of the stop device and the part of the attacking device associated with these stubs.

FIGS. 4*a*, 4*b* and 4*c* schematically represent a front view, as in FIG. 3, and a top view, of the three successive steps of the thimble stripping operation as it can be implemented using the machine illustrated in the previous figures.

EXAMPLE

FIGS. 1 to 4

The process according to the invention is described here based on a particular machine, illustrated in FIGS. 1 to 4, used to implement it.

An anode stem 110, after the anode butt is removed, is shown in FIG. 1. It is a metal reinforcement comprised of a current-conducting metal stem 120, extended along an axis 100, and a steel leg 121. The leg 121 is connected to the base of the stem 120 in a welded zone commonly called the clad 125. The leg is in the shape of an upside-down candelabrum, each branch 123 of the candelabrum being associated with a stub 122. In the case of this example, the leg 121 of the anode stem is a hexapod: it comprises 6 stubs 122. The mechanical and electrical link between the carbonaceous body and each stub is ensured by a cast iron thimble 130.

The anode stem 110 is introduced vertically into the thimble stripping machine by means of an overhead conveyor, not represented. The anode leg 121 is inserted between a stop device 200 and an attacking device 300.

The attacking device 300 is driven by a set of cylinders 340 acting vertically. To avoid encumbering the reception table, the cylinders are offset and work on a thick double beam 310 that is actuated by two cylinders 340 working at each end of the double beam thus creating a free space and without obstacles under said beam, able to collect waste which has been detached from the anode stem and has fallen.

The attacking device has punches 320 which are presented substantially in line with each stub 122. The punches 320 have a tapered shape with a low slenderness ratio, with a round end 321 which has a diameter of attack lower than that of the stubs 122.

The stop device 200 is a set of six customised units arranged in a substantially symmetrical manner in relation to the axis 100 of the anode stem. Three units are represented here. Each of them are in the form of a clamp 210, the jaws 220 of which pivot around a vertical axis and have opposite facing walls equipped with complementary cavities 230, upon being united, when said clamp is in closed position, forms a recess that has an axis aligned with that of the stub 122 and which nearly completely surrounds said stub without touching it such that said stub can move freely in the vertical direction.

The main overhead conveyor (not represented) supplies this new machine with anode stems 110 to be stripped. There is no need for auxiliary power supply equipment. Two pneumatic positioning clamps 400 position an anode stem 110 vertically on its working axis when it was introduced into the machine by the overhead conveyor.

Figure 4:
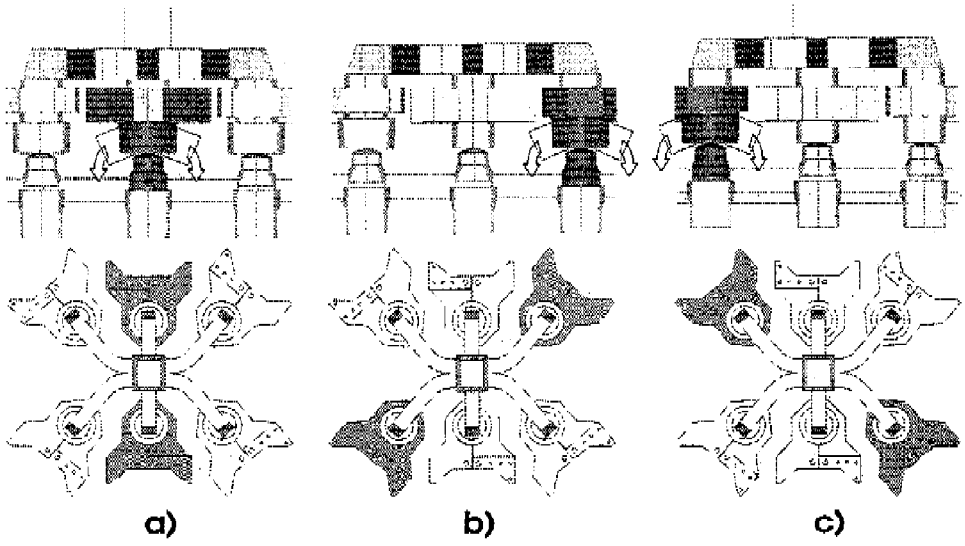

Six independent clamps 210 are arranged with respect to the symmetries of the hexapod. Three clamps located on the same side of a symmetrical plane are illustrated in FIGS. 3 and 4 (210.1, 210.2, 210.3). The six clamps are actuated by six hydraulic cylinders. They are mounted in a floating manner in relation to the fixed frame of the machine in order to accept the geometric positioning defects of the stubs between themselves. These clamps are self-locked in closed position.

There are three pairs of clamps that are symmetrical in relation to the axis 100 of the anode stem, each pair of clamps having different thicknesses:

The 2 clamps 210.2 are the thickest; they are intended to strip the centre stubs 130.2: their lower faces act as stop surfaces 211.2, preventing the thimbles 130.2 from moving forward.

The 2 clamps 210.3 have an intermediate thickness and are intended to strip the two external stubs 130.3 located on a diagonal of the hexapod; their lower faces acting as stop surfaces 211.3, preventing the thimbles 130.3 from moving forward.

The 2 clamps 210.1 are the least thick and are intended to strip the last two stubs 130.1 located on the other diagonal; their lower faces acting as stop surfaces 211.1, preventing the thimbles 130.1 from moving forward.

Six fixed stops, installed on the same horizontal plane integral with the machine frame, not represented, provide the vertical blocking of the clamps 210 during the thimble stripping operation. These stops are made of notched tubes allowing the stub support cross members to pass through as the stem rises during the thimble stripping phase.

The mobile double beam 310, guided and equipped with 6 punches 320, the peaks of which are in the same horizontal plane, located in line with the 6 stubs 122, moves vertically by means of 2 hydraulic cylinders 340 installed on either side of the machine, and ensure the actual thimble stripping operation. The hydraulic control of these 2 cylinders is ensured by rotary encoders that guarantee nearly horizontal movement of the mobile beam, regardless of the forces exerted by each of them. In this way, the punches reach the lower ends of the stubs nearly simultaneously. The thimbles are attacked in twos, symmetrically in relation to the axis of the anode stem 110. If a thimble "releases" slightly before the other symmetrical thimble associated with it, a sudden and significant imbalance may follow on the attack device. In order to prevent this, the attacking device is equipped with guide shoes 350 that slide on the vertical walls integral to the machine frame, not illustrated in the figures.

The "thimble stripping" operation is performed in the following order:

The anode stem 110 to be stripped is introduced into the machine, via the overhead conveyor.

The pneumatic stem centring clamp 400 closes, centring the stem on its working axis.

The mobile double beam 310 is raised and the 6 punches 320 come into contact with the lower faces of the 6 stubs 122, which results in the following:

the stem is raised and the suspension chains are released, thus preventing damaging parasite forces to be generated in the overhead conveyor, the cross members used to support the stubs are introduced into the notched tubular stops, When the mobile double beam 310 reaches a predefined position, the 6 hydraulic clamps 210 close on the 6 stubs 122 in a zone located between the top of the thimbles and the bottom of the cross members.

The stem centring clamps 400 are thus opened to prevent parasitic stresses that could be introduced in the clad 125 during successive thimble stripping operations.

As the mobile double beam continues to rise, the lower face of the 2 central clamps 210.2 first contact the upper annular wall of the first 2 thimbles 130.2. With the upper face of the clamps being in contact with the machine's 2 fixed stops, these 2 thimbles are immobilised while the 2 punches 320.2 continue to rise, which causes the thimbles 130.2 of the stubs 122.2 to detach (FIG. 4*a*).

Secondly (FIG. 4*b*), that is after the first 2 thimbles have been detached from their respective stubs, the 2 external clamps 210.3 located on a diagonal of the hexapod in turn come into contact with the annular section of the next 2 thimbles 130.3, and the thimble stripping operation, similar to the previous operation, takes place.

In a last phase (FIG. 4*c*), that is after detaching the preceding 2 thimbles, the last 2 clamps 210.1 located on the other diagonal of the hexapod perform the final thimble stripping operations in the same manner, by detaching the thimbles 130.1 from the stubs 122.1.

While the punches are rising, and owing to their specific profile, the thimbles shatter in several pieces which fall and are collected in the lower part by a hopper 500 which feeds a conveyor 600. Here, the cast iron wastes are sent to the sealing workshop where new anode blocks are secured to the recycled anode stems.

When the mobile double beam 310 reaches a maximum predetermined high level, it begins its return movement in low position. When the beam reaches the predetermined position used to close the 6 clamps, the latter are reopened. The movement continues until the anode stem, cleared of its thimbles, is again suspended by its chains.

The anode stem, thus stripped of its thimbles, is then removed from the machine via the overhead conveyor.

The invention claimed is:

1. A process for removing in a single step n thimbles, with n being a whole number greater than or equal to 3, attached to n stubs of an anode stem leg, comprising at least the following steps:

a) said anode stem leg is placed between a stop device and an attacking device, said attacking device can be moved using an actuator towards said stop device, said stop device at least partially surrounding each of the n stubs of said anode stem leg and having a stop surface that stops the corresponding thimble from moving forward;

b) movement of the attacking device in the direction of the stop device so that said attack device enters into contact with the anode leg and drives it until said anode leg comes into contact with said stop device;

c) continuation of the movement of said attack device so that each thimble, blocked by the associated stop surface, is detached from the corresponding stub;

f) stop and withdraw of the attacking device;

said process being characterised in that a stop device is used comprising at least two separate stop surfaces, separated from one another by an axial distance such that the thimbles blocked by a first stop surface are detached from the stubs to which they were secured before other thimbles are blocked by the other stop surface.

2. The process according to claim 1 characterised in that said stem leg having p pairs of associated peripheral stubs, symmetrical in relation to the axis of the stem, p being a whole number greater than or equal to 1, and possibly having an axial stub, the stop device comprises at least a first stop surface intended to prevent the forward movement of thimbles fixed on two associated peripheral stubs, symmetrical in relation to the stem axis and a second stop surface, shifted axially in relation to the first stop surface, intended to block either a second pair of thimbles fixed on other associated peripheral stubs or, if it exists, the thimble fixed on the axial stub.

3. The process according to claim 2 characterised in that to each pair of associated peripheral stubs corresponds a specific stop level, shifted axially from that of the other pairs of peripheral stubs and that of the axial stub, if it exists.

4. The process according to claim 1 in which said stop device is a set of individual stop units, each associated with a single stub.

5. The process according to claim 4 in which each of the individual stop units comprises a fixed stop wall integral with the machine frame and a device mounted in a floating manner being placed on the thimble when it comes into contact with it such that the contact surface with the upper end of the thimble is as large as possible, said placement being performed before, driven by the thimble, said device mounted in a floating manner itself bears against said stop integral with the machine frame.

6. The process according to claim 1 in which said stop device is a set of clamps, whose lower face forms, once the clamp is closed around a stub, a stop surface preventing the corresponding thimble from moving.

7. The process according to claim 4 in which the stop units are sets of jaws that pivot around horizontal axes and which, once brought together, form a sort of sleeve that surrounds the stub and whose lower end is equipped with a stop surface preventing the thimbles from moving.

8. The process according to claim 1 in which said attacking device comprises n punches that move along the axes of the n stubs and which are mounted on a common transverse beam or on several transverse beams arranged symmetrically in relation to the median plane parallel to the large side of the anode block.

9. The process according to claim 8 in which said attacking device is equipped with guide shoes that slide on vertical walls integral with the machine frame, designed to act as guide walls to the vertical movement of said attacking device.

10. A thimble stripping machine able to strip spent anodes and scraped new anodes from stubs comprising a stop device and an attacking device, said attacking device able to be moved by means of an actuator in the direction of said stop device, said stop device surrounding, at least partially, each stub of the anode stem leg and comprising at least two stop surfaces separated from one another by an axial distance such that the thimbles blocked by a first stop surface are detached from the stubs to which they were secured before the other thimbles are blocked by the other stop surface.

11. The machine according to claim 10 in which the stop device comprises at least a first stop surface designed to block the forward movement of the thimbles fixed on two associated peripheral stubs, symmetrical in relation to the stem axis and a second stop surface, shifted axially in relation to the first stop surface, designed to either block a second pair of thimbles fixed on other associated peripheral stubs or, if it exists, the thimble fixed on the axial stub.

12. The machine according to claim 11 in which each pair of associated peripheral stubs corresponds a specific stop level, shifted axially from that of the other pairs of peripheral stubs and that of the axial stub, if it exists.

13. The machine according to claim 10 in which said stop device is a set of individual stop units, each associated with a single stub.

14. The machine according to claim 13 in which each of the individual stop units comprises a fixed stop integral with the machine frame and a device mounted in a floating manner in relation to the machine frame, said device mounted in a floating manner being placed on the thimble when the latter comes into contact with the device such that the contact surface with the upper end of the thimble is as large as possible, said placement being performed before, driven by the thimble, said device mounted in a floating manner itself bears against said stop integral with the machine frame.

15. The machine according to claim 10 in which said stop device is a set of clamps, whose lower face forms, once the clamp is closed around a stub, a stop surface preventing the corresponding thimble from moving.

16. The machine according to claim 14 in which the stop units are sets of jaws that pivot around horizontal axes and which, once brought together, form a sort of sleeve that surrounds the stub and whose lower end is equipped with a stop surface preventing the thimbles from moving.

17. The machine according to claim 15 in which said clamps bear on a face on one or several elements integral with the frame, located on the same level in relation to the forward movement of the attacking device, and have different thicknesses, so that they present their other face as a stop surface shifted axially in relation to the corresponding faces of the other clamps.

18. The machine according to claim 10 characterised in that said attacking device comprises n punches that move along the axes of n stubs and which are mounted on a common transverse beam or on several transverse beams arranged symmetrically in relation to the median plane parallel to the large side of the anode block.

19. The machine according to claim 18 in which said attacking device is equipped with guide shoes that slide on vertical walls integral with the machine frame, designed to act as guide walls to the vertical movement of said attacking device.

20. A process designed to extract the anode butt and the thimbles attached to the stubs of a spent anode or to a scrapped new anode, comprising the following stages:

a) placement of the spent anode butt between a stop device and an attacking device, said attacking device being movable using an actuator in the direction of said stop device, said stop device comprising a butt stop device having a first stop blocking the forward movement of the butt, said butt stop device also comprising a thimble stop device of the thimbles surrounding, at least partially, each stub and having a second stop which stops said thimbles from moving forward;

b) the spent anode is moved until the butt is blocked by the first stop;

c) the attacking device is moved towards the stop device so that it arrives in contact with said anode butt and imposes on said butt such a force as to cause it to break up and the fragments to be detached from the butt;

d) the fragments of the butt are removed;

e) the attacking device continues to move so that the thimbles are blocked by the second stop and are detached from the stubs;

f) the attacking device stops and is withdrawn;

said process being characterised in that the thimble stop device comprises at least first and second separate stop surfaces, separated from one another by an axial distance such that the thimbles blocked by the first stop surface are detached from the stubs to which they were associated before other thimbles are blocked by the second stop surface.

21. The process according to claim 20 in which the minimal axial distance between the second stop and the first stop is greater than a value, substantially corresponding to the height of said thimbles.

22. A anode butt and thimble stripping machine allowing the anode butt and the thimbles attached to a spent anode or a scrapped new anode to be extracted, comprising a stop device and an attacking device, said attacking device being movable using an actuator in the direction of said stop device, said stop device comprising a butt stop device having a first stop stopping the butt from moving forward, said stop device also comprising a thimble stop device of the thimbles surrounding, at least partially, each stub and having a second stop that stops said thimbles from moving forward, characterised in that the thimble stop device comprises at least first and second stop surfaces separated from one another by an axial distance such that the thimbles blocked by the first stop surface are detached from the stubs to which they are secured before other thimbles are blocked by the second stop surface.

* * * * *